US005935342A

United States Patent [19]

Boyd

[11] Patent Number: 5,935,342

[45] Date of Patent: Aug. 10, 1999

[54] PAINT ROLLER CLEANER

[76] Inventor: Phillip B Boyd, 3206 Mayfield Dr., Johnson City, Tenn. 37604

[21] Appl. No.: 08/999,066

[22] Filed: Dec. 3, 1997

[51] Int. Cl.[6] ..... B08B 3/02

[52] U.S. Cl. ..... 134/33; 134/138; 134/144; 134/900

[58] Field of Search ..... 134/900, 138, 134/144, 33, 38

[56] References Cited

U.S. PATENT DOCUMENTS

| | | | |
|---|---|---|---|
| 3,688,785 | 9/1972 | Stevens et al. | 134/900 X |
| 3,873,364 | 3/1975 | Smith | 134/900 X |
| 4,402,333 | 9/1983 | Frizzell et al. | 134/900 X |
| 4,508,465 | 4/1985 | Orton | 134/900 X |
| 4,641,673 | 2/1987 | Conley et al. | 134/900 X |
| 4,672,987 | 6/1987 | Brandt | 134/900 X |
| 4,708,152 | 11/1987 | Hibberd | 134/900 X |
| 4,711,258 | 12/1987 | Rossborough et al. | 134/900 X |
| 5,005,598 | 4/1991 | Hodgdon | 134/900 X |
| 5,095,928 | 3/1992 | Phipps | 134/900 X |
| 5,337,769 | 8/1994 | Howe | 134/900 X |
| 5,413,133 | 5/1995 | Russell | 134/900 X |
| 5,487,399 | 1/1996 | Hannah | 134/900 X |
| 5,505,220 | 4/1996 | Gorecki | 134/900 X |

*Primary Examiner*—Philip R. Coe
*Attorney, Agent, or Firm*—Adrian J. Good

[57] ABSTRACT

A paint roller cleaner consists of a tubular body holding a paint roller covered, with a traversing nozzle spraying a liquid whereby the roller is cleaned after use.

6 Claims, 4 Drawing Sheets

Fig. 3A
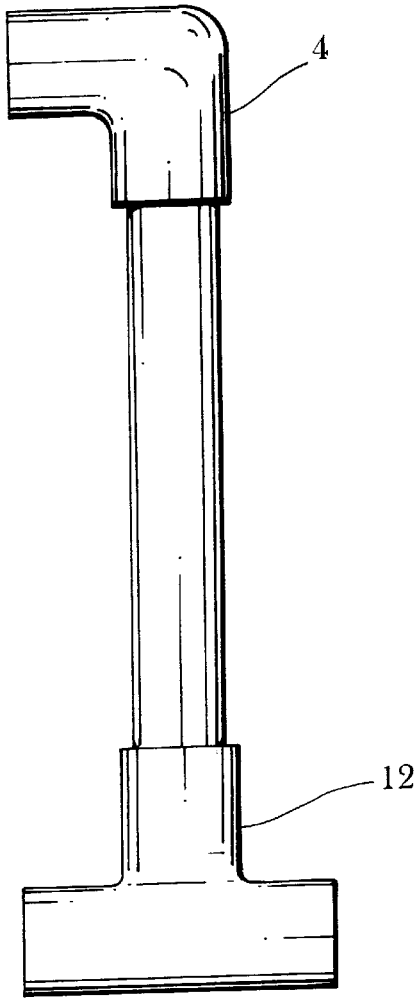
Fig. 3B
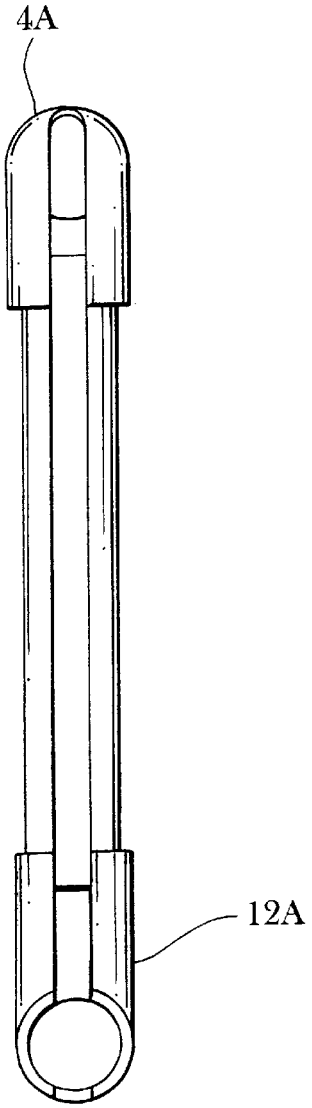
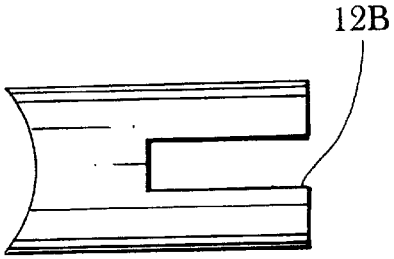
Fig. 3C

PAINT ROLLER CLEANER

BACKGROUND OF THE INVENTION

One of the useful tools available to the painter today is the paint roller. It enables the artisan or the amateur to cover an area much quicker and with less effort than a brush, the old standard, particularly of professional house painters. One defect attached to the paint roller is the difficulty in cleaning it when the job is done. The roller has a much larger area than a brush and with the usual fairly dense nap is difficult to clean by hand.

Previous efforts in this field have included Frizzell, U.S. Pat. No. 4,402,333 disclosing a roller cleaner using a water jet to simultaneously wash and spin a paint roller; Russell, U.S. Pat. No. 5,413,133 disclosing a roller cleaner with a multiple orifice spraying the roller; Phipps, U.S. Pat. No. 5,095,928, also disclosing a cleaner with multiple jets impinging on a roller; Orton, U.S. Pat. No. 4,508,465 disclosing a garden hose attachment with a combination soaker and scraper to clean a roller; Hibberd, U.S. Pat. No. 4,708,152 disclosing a cleaner with a plurality of fan jets directed at the roller; Howe, U.S. Pat. No. 5,337,769 disclosing a drum device with a garden hose attachment spraying the roller, and Smith, U.S. Pat. No. 3,873,364 disclosing a paint roller horizontally mounted on a spindle in a downwardly opening hollow housing.

U.S. Pat. No. 5,505,220 discloses a paint roller cleaner having a tubular casing with four legs and two spray bars and an enclosed bottom surface.

U.S. Pat. No. 5,487,399 discloses a paint roller cleaner in which the roller is separated from the frame and mounted on a freely rotatable support frame with an internal spray tube at the center and an external spray tube on the outside of the housing with multiple spray nozzles.

OBJECTS OF THE INVENTION

Our object is the provision of a paint roller cleaner which may be used with various coatings and liquids and which will accommodate varied types of paint rollers to clean and dry them quickly and economically and is especially adapted for latex or water-dispersed vehicles.

DESCRIPTION OF THE DRAWINGS

FIG. 3 shows a back view 4A of the handle 4 with roller frame gripper 12A, side view of handle 4 and roller frame gripper 12, and plan view of roller frame gripper 12.

DETAILED DESCRIPTION OF THE INVENTION

Figure 1:
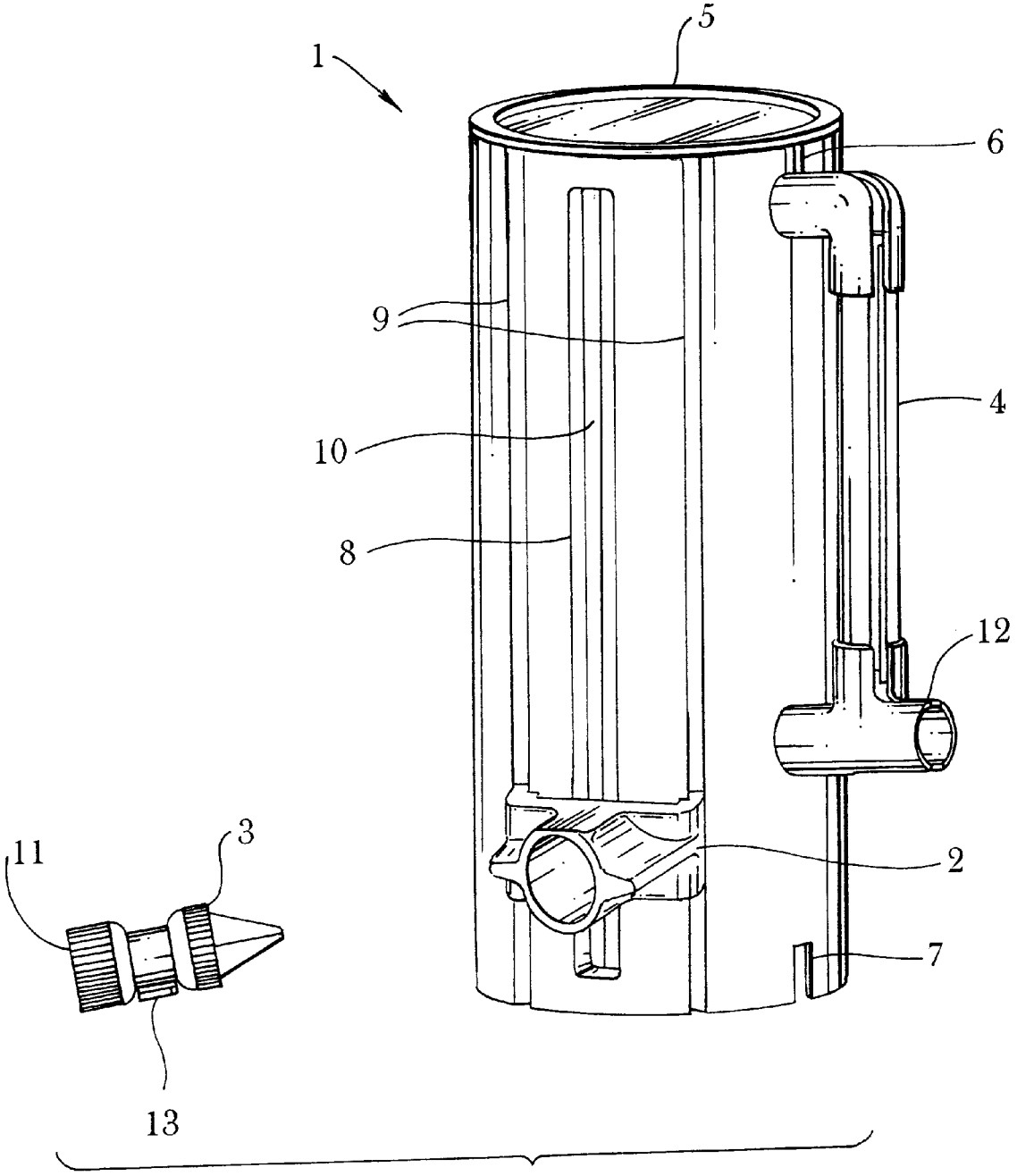
In FIG. 1 jet slider 2 with water jet 3, with hose connection 11 and pressure regulator 13 moves vertically in jet slot 8, slider 2 riding in slots 9 vertically. Jet slot 8 has inner flexible seal. Self adjusting handle 4 holds the roller handle in place, with the roller inside and the bottom of the handle held by gripper 12. The roller handle is placed in slot 6 before operation, with lid 5 removable. Slot 7 allows the device to be inverted to accommodate other types of paint rollers.
Figure 2:
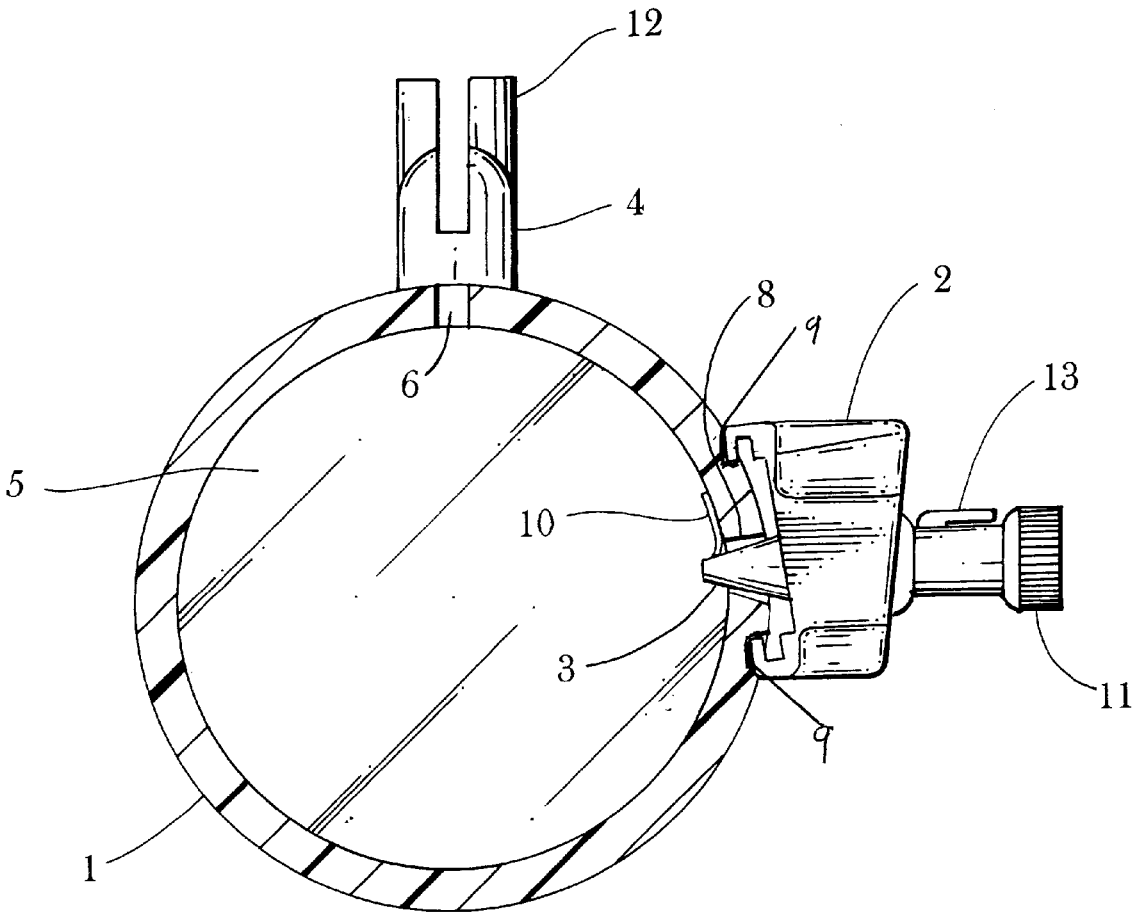
FIG. 2 is a top view of the unit, with body 1, normally of plastic, as PVC, but no limitations is placed on the composition, as it could be metal, thermoplastic, or thermoset plastic. 2 is the jet slider with water jet 3, hose connection 11 and regulator 13. Slide 2 is guided vertically in tracks 9, with inner seal 10. Roller handle fits in slot 6 with self-adjusting handle 4 and roller frame gripper 12. Cover 5 is normally transparent for visual inspection of the roller.
Figure 4A:
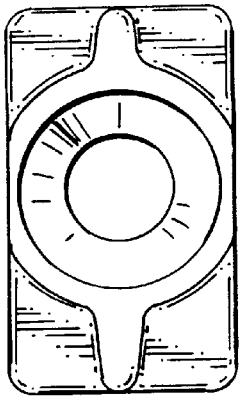
FIG. 4 shows the various parts of the jet slider 2 with water jet 3, hose connection 11 and pressure regulator 13.
Figure 4B:
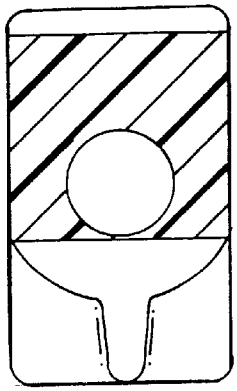
Figure 4C:
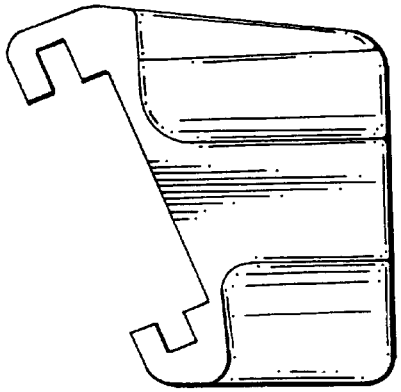
Figure 4D:
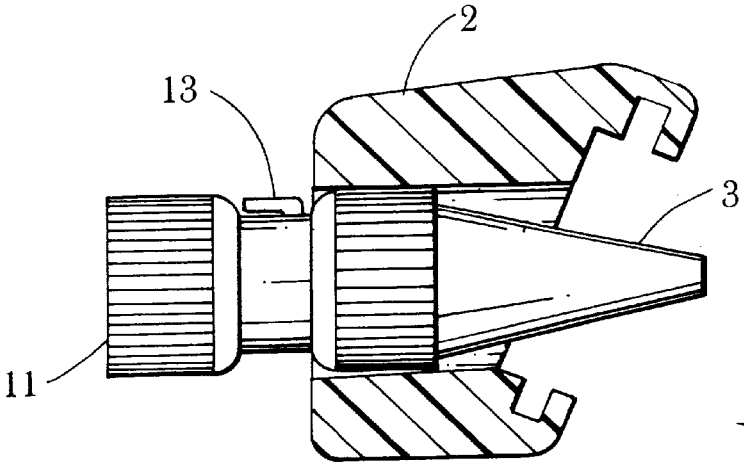

My invention is an apparatus specifically designed for cleaning paint rollers, used mainly in water-based so-called latex paints. The body of the roller cleaner is a vertical hollow section normally of plastic such as PVC (poly-vinyl chloride) or metal with a transparent lid. A spray nozzle or jet slider may be of any suitable material, here shown as metal, but may a plastic, which can be vertically raised and lowered through slots in the body and in a side channel to impinge a spray at a tangent to a paint roller with handle fitting in a slot in the cleaner handle to spray the roller at a tangent while causing it to spin rapidly, thus spraying the water and paint mixture on the wall of cleaner by centrifugal force and allowing it to run off the wall the out the bottom of cleaner. At the bottom of slots a lock-down point will hold the nozzle in place to impinge a spray on the bottom edge of roller, spinning it very rapidly at a high RPM and thus producing a clean and dry roller by the combination of spray and centrifugal force and the rinse water-paint mixture being spun off roller. The spray will usually be water from a garden, however a solvent may be used to clean solvent-carried coatings.

I claim:

1. A paint roller cleaner wherein a paint roller is held in a hollow body with a removable lid on the top by fitting in a slot in a handle attached to said body, the handle of said paint roller fitting in said slot in said handle of said paint roller cleaner and in a slot in the top of the body in alignment with the slot in the handle such that said roller is held in the center of said hollow body, said hollow body having a jet slider spray nozzle traversing a vertical slot in the side of said hollow body, whereby said nozzle may impinge a water or solvent spray on said roller at a tangent, causing said roller to spin, thus removing the paint-liquid mixture to be spun off said roller to the wall of said hollow body, allowing said mixture to run out the bottom of said hollow body, wherein said body has a stationary alignment point at the bottom vertical slot in said hollow body wherein said nozzle may be held in place to spray the bottom edge of said roller, causing said roller to spin rapidly, causing centrifugal force to remove the liquid to produce a clean and dry roller, and renew the nap of the roller in one process, whereby the operator may snap the roller handle into the handle on the hollow body, attach a solvent or water source to the jet nozzle, traverse said vertical slot while spraying said roller, and when the liquid running off the roller in clear, hold said nozzle at the stationary alignment point position on said body, and impinge the spray on the bottom edge of said roller, spinning it rapidly and drying the nap of said roller by centrifugal force to produce a clean and dry roller.

2. The paint roller of claim 1 having a partial slot in the normal bottom to hold a paint roller different size diameter handle than the normal when the cleaner is held inverted from the normal position with lid placed on the top but placed on the bottom when wherein said jet slider is traversed in the vertical slot and for drying the nap of said roller is held at the normal top of the vertical slot to spin said roller rapidly by tangential force of the jet thus drying the nap of the roller rapidly and completely.

3. The paint roller cleaner of claim 1 wherein the jet slider has elements engaging tracks parallel to the vertical slot adapted to hold said slider in alignment with said slot.

4. A paint roller cleaner comprising a vertical plastic tube having a vertical slot extended a majority of the distance from top to bottom, said slot adapted to hold a jet slider spray nozzle allowing it to traverse said slot, two tracks parallel to said slot holding said jet slider spray nozzle in alignment with said slot, a handle having a slot adapted to hold a paint roller in place with the roller centered in said tube, said nozzle adapted to spray a liquid on said roller at a tangent whereby said roller is simultaneously washed and spun, said nozzle having means adapted to follow said tracks, pressure and/or volume control means and liquid supply attachment, a lid on said tube which may be removed and placed on the normal bottom end of said tube when inverted, said nozzle adapted to lock in the stationary alignment point at the bottom of said vertical slot to spray the bottom edge of the roller, causing it to spin at a high velocity thereby extracting the wash liquid from the roller and bringing the roller to almost complete dryness, when the wash liquid becomes clear signifying a clean roller.

5. A paint roller cleaner comprising a hollow tubular body having a slot in the top edge of said body wherein said paint roller cleaner has means to hold said roller at the center of said body, said body having a vertical slot through which a sliding jet with a hose attachment may traverse vertically to direct a spray on said roller holding paint at a tangent causing said roller to spin rapidly, dispensing the paint-water mixture on the internal walls of said body and allowing said mixture to flow out of the bottom of said cleaner, said cleaner having means to hold the handle of said roller in place, said vertical slot having a flexible cover fastened at one side of said slot to prevent the paint-water mixture from flowing out the vertical slot, said slot having a stationary alignment point at the bottom edge of the roller, causing the roller to spin very rapidly, whereby accelerating the drying process for said roller, said jet slider having means to hold said jet in said vertical slot.

6. A process for cleaning a paint roller with an angled handle with paint on it after use wherein said roller is fastened in the center of a paint roller cleaner comprised of a hollow tubular body with an open bottom, having a slot adapted to hold said handle in the top of said body wherein said roller is placed at the center of said body, said roller being cleaned of paint by the application of a jet of water sprayed at a tangent to the surface circumference by a sliding jet attached to a water source, said jet situated in a vertical slot in the side of said body, said jet traversing said slot thereby applying a jet of water to the total surface of said roller, thus spinning said roller by tangential application of the force of said jet, whereby a mixture of paint and water is thrown off said roller and deposited on the internal wall of said body and allowed to run out the bottom of said body, said jet impinging at the bottom edge of said roller, when held at the stationary alignment point, spinning it rapidly thereby drying said roller when all of the paint on said roller is cleaned off the roller, whereas said unit is self-cleaning due to this process.

* * * * *